US009896917B2

(12) United States Patent
Sizonenko et al.

(10) Patent No.: US 9,896,917 B2
(45) Date of Patent: Feb. 20, 2018

(54) OIL PRODUCTION INTENSIFICATION DEVICE AND METHOD

(71) Applicants: Olga Nikolaevna Sizonenko, Nikolayev (UA); Alexander Ivanovich Vovchenko, Nikolayev (UA); Igor Semenovich Alexandrov, New York, NY (US)

(72) Inventors: Olga Nikolaevna Sizonenko, Nikolayev (UA); Alexander Ivanovich Vovchenko, Nikolayev (UA); Igor Semenovich Alexandrov, New York, NY (US)

( * ) Notice: Subject to any disclaimer, the term of this patent is extended or adjusted under 35 U.S.C. 154(b) by 0 days.

(21) Appl. No.: 14/505,015

(22) Filed: Oct. 2, 2014

(65) Prior Publication Data

US 2016/0010440 A1 Jan. 14, 2016

(30) Foreign Application Priority Data

Aug. 2, 2013 (UA) ..... 201309638 U

(51) Int. Cl.

| | |
|---|---|
| ***E21B 43/24*** | (2006.01) |
| ***E21B 43/16*** | (2006.01) |
| ***E21B 43/00*** | (2006.01) |
| ***E21B 43/25*** | (2006.01) |

(52) U.S. Cl.

CPC ..... *E21B 43/16* (2013.01); *E21B 43/003* (2013.01); *E21B 43/25* (2013.01)

(58) Field of Classification Search

CPC ..... E21B 43/16; E21B 43/24
USPC ..... 166/248
See application file for complete search history.

(56) References Cited

U.S. PATENT DOCUMENTS

| | | | |
|---|---|---|---|
| 4,074,758 | A | 2/1978 | Scott |
| 4,167,978 | A | 9/1979 | Kirchner |
| 4,169,503 | A | 10/1979 | Scott |
| 4,345,650 | A | 8/1982 | Wesley |

(Continued)

FOREIGN PATENT DOCUMENTS

| | | | |
|---|---|---|---|
| RU | 02144980 | C1 | 1/2000 |
| RU | 02184221 | C1 | 6/2002 |

(Continued)

*Primary Examiner* — Doug Hutton, Jr.
*Assistant Examiner* — Avi Skaist
(74) *Attorney, Agent, or Firm* — Cargill & Associates, PLLC; Lynn E. Cargill

(57) ABSTRACT

The oil production intensification method includes injecting the reagent into the reservoir and treating the bottom zone of the well with high voltage pulse discharges with an electric discharge device continuously traveling from bottom to top in the atmosphere of such reagent. The number of pulses of such high voltage pulse discharges is set subject to the real porosity of the reservoir and the empirical dependence of the number of pulses of high voltage pulse discharges per meter of the reservoir and porosity of rocks pre-estimated with the core material. After the electric discharge device stops traveling up, the treatment with high voltage pulse discharges also stops, and the well is pressurized until the pressure stabilizes in it. Then, the bottom hole area of the well is further treated with high voltage pulses as the electric discharge device travels from top to bottom. Whereby an intensified oil production is realized, from 2 to 20 times more oil may be extracted.

2 Claims, 1 Drawing Sheet

(56) References Cited

U.S. PATENT DOCUMENTS

| | | | | |
|---|---|---|---|---|
| 6,227,293 | B1 | 5/2001 | Huffman et al. | |
| 6,499,536 | B1 * | 12/2002 | Ellingsen | E21B 43/003 166/248 |
| 2001/0011590 | A1 | 8/2001 | Thomas et al. | |
| 2010/0270038 | A1 * | 10/2010 | Looney et al. | 166/402 |
| 2014/0027110 | A1 * | 1/2014 | Ageev | H05H 1/52 166/249 |
| 2014/0251599 | A1 * | 9/2014 | Linetskiy | 166/248 |

FOREIGN PATENT DOCUMENTS

| | | | |
|---|---|---|---|
| RU | 02194846 | C2 | 12/2002 |
| RU | 02199659 | C1 | 2/2003 |
| RU | 0002213860 | C2 | 10/2003 |
| RU | 02261986 | C1 | 10/2005 |
| RU | 02272128 | C1 | 3/2006 |
| RU | 02282021 | C2 | 8/2006 |
| RU | 02283950 | C2 | 9/2006 |
| RU | 02295031 | C2 | 3/2007 |
| RU | 02298641 | C2 | 5/2007 |
| RU | 02298642 | C1 | 5/2007 |
| RU | 02314412 | C1 | 1/2008 |
| RU | 02317409 | C1 | 2/2008 |
| RU | 02327027 | C2 | 6/2008 |
| RU | 2007101698/03 | A | 7/2008 |
| RU | 02335658 | C2 | 10/2008 |
| RU | 0002520672 | C2 | 6/2014 |

* cited by examiner

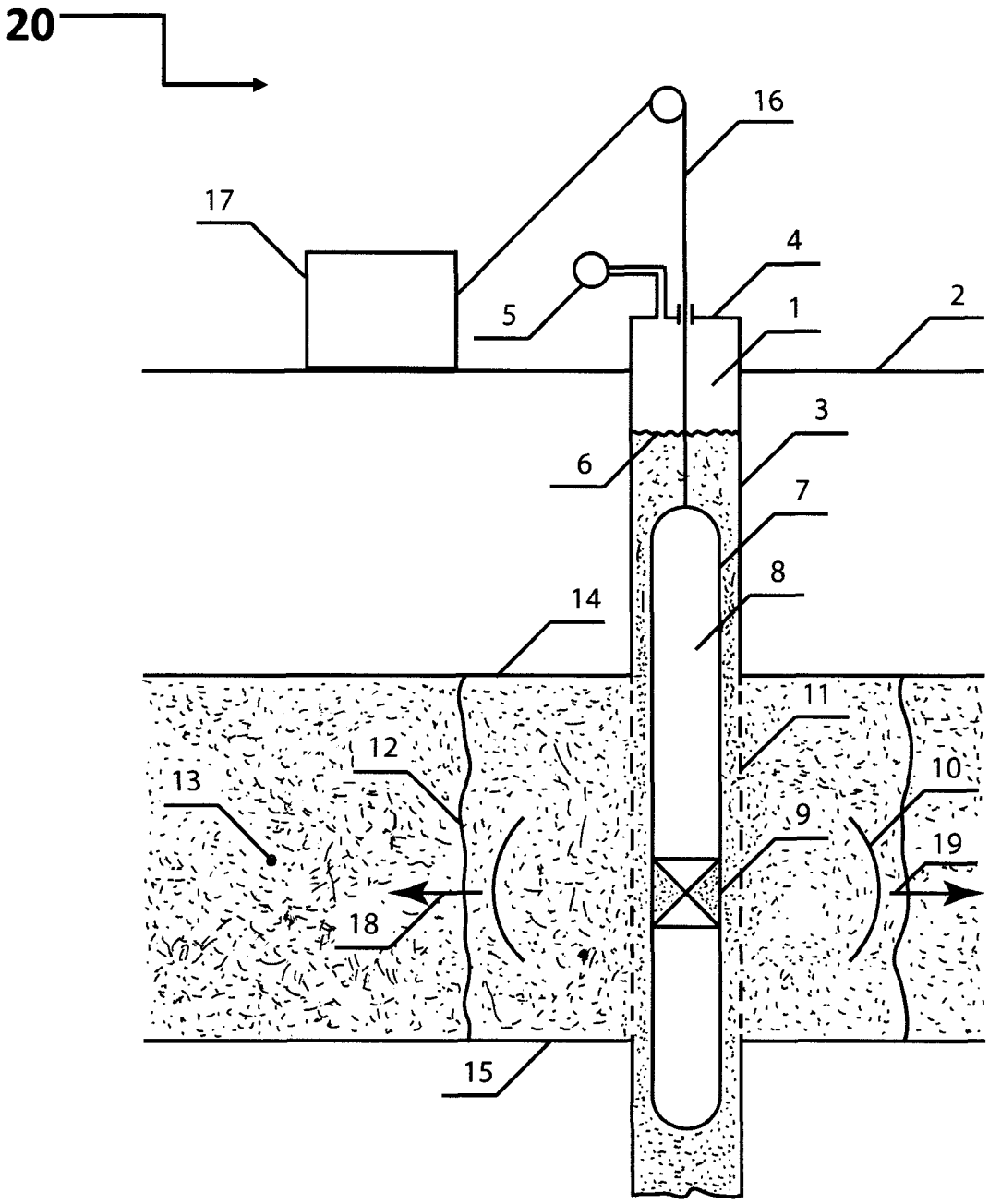
20
16
17
4
5
1
2
3
6
7
8
14
11
12
10
13
9
19
18
15

OIL PRODUCTION INTENSIFICATION DEVICE AND METHOD

CROSS-REFERENCE TO RELATED APPLICATIONS

This application claims the benefit of priority under 35 U.S.C. 119(b) of Ukraine Utility Application No. U 2013 09638, filed on Aug. 2, 2013 (Ukraine Patent No. 90595, issued Jun. 10, 2014).

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present invention relates to the oil and gas industry and especially to treatments to the bottom hole area of an oil well colmated with different deposits with the aim of increasing the flow of oil, gas, and gas condensate.

2. Description of the Prior Art

A common problem in oil and gas industry is that oil wells have been drilled become clogged and the flow of oil there from decreases dramatically. While wells that initially produced 50 or more barrels per day may only flow one barrel a day after a length of time.

There are some conventional methods for unclogging perforations in an oil well casing, including the use of high-voltage pulsed discharges. However, these methods do not significantly extend the lifetime of oil well, nor do they do the job to the extent that the oil and gas industry would like.

One such well-known method involves an oil production intensification method which provides that the bottom hole area of the well should be treated with high voltage pulse discharges performed cyclically with a frequency of 4-10 Hz for 5-15 minutes. It is well known that the oil from the well should be sampled. [see RU Patent No. 2,055,171, Amotov et al., "Method for Stimulation of Oil Recovery"].

Another conventional oil production intensification method relevant to the present invention involves pulse treatment of the bottom hole area of the well with high voltage pulse discharges with an electric discharge device performed at least in three identical successive cycles in the impact and holding mode, and oil sampling [see RU Patent No. 2,097,546, Sizonenko et al., "Method of Intensifying Oil Production"]. In such case, the core material is used to establish the empirical dependence of the number of pulses of high voltage pulse discharges in cycle per meter of the reservoir and porosity of rocks. Before the bottom hole of the well is treated with high voltage pulse discharges, the reagent is injected into the reservoir, and the bottom hole area of the well is treated with high voltage pulse discharges in the midst of the reagent over the entire interval of the reservoir as the electric discharge device continuously moves from bottom to top. The number of pulses of electrical discharges and the rate with which the electric discharge device moves are set subject to the real porosity of the reservoir and pre-estimated empirical dependence. The delay time for each cycle is minimally 30 minutes. 0.3% water solutions of multi-functional compounds of surface active substances are typically used as the reagent to unclog the perforations. Although this system functions well, there is still room for improvement.

Therefore, it is a desire of the oil and gas industry to have a new device and method that will provide a much more effective oil recovery intensification system, so that old oil wells can be rejuvenated and continue to produce significant amounts of oil without having to drill new holes.

SUMMARY OF THE INVENTION

In accordance with the present invention, there is disclosed a new device and method of using the device to more thoroughly unclog perforations in oil well casings than conventional methods of cleaning out the casing. By clearing out and/or dissolving such blockages from the perforations in the oil well casings and the surrounding ground structure near an oil reservoir, more oil can be removed from the well. In practice, an oil well can become so clogged that it is only able to produce one barrel of oil per day, from an initial amount of barrels per day. The present invention can restore those oil wells to producing more barrels again. To achieve the desirable result of higher production from the well, the bottom hole area of the well is treated with high voltage pulse discharges while pressurizing the system until there is no longer a change in pressure.

The method of the present invention includes injecting a pre-selected reagent into the reservoir, treating the bottom zone of the well with high voltage pulse discharges with an electric discharge device that is being lowered down and pulled up by a wire from the bottom of the oil reservoir up to the top of the reservoir in the midst of such reagent while making high voltage pulse discharges. The number of pulses of high voltage pulse discharges is subject to the real porosity of the reservoir and the empirical dependence of the number of pulses of high voltage pulse discharges per meter of the reservoir and porosity of rocks pre-estimated with the core material.

Capping the opening into the oil well allows for pressure to build-up while the pulse discharging is going on. In fact, by monitoring the pressures inside the capped well, one can determine whether or not the reaction is continuing, or if it is stabilized, can be determined, such that it can be determined that any chemical reaction between the reagents and materials inside the oil well have come to an equilibrium point, and will no longer be reacting. Once this stabilization of pressure has been established, it is time to move the high-voltage pulse discharge device from top to bottom of the perforation zone.

This method does not require removing the products of chemical reactions of reagent solutions both with colmated formations in the bottom hole area of the well and with the rocks which form the producing reservoir.

Depending on the nature of the material clogging the well, suitable reagents are selected to place down into the oil well. By applying high voltage pulse discharges in the vicinity of the oil reservoir, the reagent either dissolves the clog, or renders it into a state that can be removed from the well, thereby removing the clogs. This procedure generally produces gaseous reaction products, and this creates a higher than normal pressure, which can be measured and detected.

By capping the well and monitoring its interior pressure, completion of the reaction below can be gauged. Once the pressure stabilizes, it is clear that the reaction is completed, and the practitioner can move on to the next stage.

BRIEF DESCRIPTION OF THE DRAWING

For a further understanding of the nature and advantages of the expected scope and various aspects of the present invention, reference shall be made to the following detailed description, and when taken in conjunction with the accompanying drawing, wherein:

FIG. 1 is a side elevational view of an oil production intensification device made in accordance with the present invention.

DETAILED DESCRIPTION OF THE INVENTION

Referring now to the drawing in detail, FIG. 1 is a side elevational view of an oil production intensification device generally indicated by the numeral 20, which also includes a well 1 emerging from ground level 2. Holding back the ground from collapsing is well casing 4, terminating in preventer well cap 4. A manometer 5 is used for well pressure readings. Well is filled with fluid 6. Inside the well casing 3 is a slidably disposed electric discharge device which includes a high voltage power supply and controller 8.

A discharge zone 9 is encased within the electric discharge device 7, sending out shock waves 10. The perforation area 11 is seen here as a slitted area so that the discharge can permeate through to well bore near area 12 inside productive strata 13. The top 14 and the bottom 15 define productive strata 13. Wireline 16 is used to controllably slide electric discharge device 7 in an up and down fashion so as to provide full coverage from the electric discharge device 7 of the productive strata 13 from top 14 to bottom 15. Above ground, a ground wireline track 17, including a winch, an initial power supply and control equipment, is used to move the electric discharge device 7 up and down in the well casing. A shock wave and reagent flow is shown through the surrounding ground by arrows 18 and 19.

The present invention is to improve the oil production intensification method by introducing new operations which enable the reagent solution completely to react with colmated formations to remove the products of such chemical reactions of the reagent solution with colmated formations, and thus improve the efficiency of treating the bottom hole area of the well which is colmated with various deposits and significantly increase the inflow of oil, gas, and gas condensate.

In order to achieve a desirable result, the oil production intensification method includes injecting the reagent into the reservoir and treating the bottom zone of the well with high voltage pulse discharges with an electric discharge device continuously moving from bottom to top in the midst of such reagent. The number of pulses of high voltage pulse discharges is set subject to the real porosity of the reservoir and the empirical dependence of the number of pulses of high voltage pulse discharges per meter of the reservoir and porosity of rocks pre-estimated with the core material. According to the invention, after the electric discharge device stops traveling up, the treatment with high voltage pulse discharges also stops, and the well is pressurized until the pressure stabilizes in it. Then, the bottom hole area of the well is further treated with high voltage pulses as the electric discharge device moves from top to bottom.

In order to establish the causal link between the overall description of the applied method and the technical result, the following should be noted. The feature "after the electric discharge device stops traveling up, the treatment with high voltage pulse discharges also stops, and the well is pressurized until the pressure stabilizes in it" enables the reagent solution completely to react with colmated formations. Such features as "then, the bottom hole area of the well is treated with high voltage pulse discharges as the electric discharge device moves from top to bottom" enables to remove the products of chemical interaction of the reagent solution with colmated formations. The method is implemented as follows.

The composition of the deposits of the productive reservoir is determined.

When treating the wells which expose permeable productive formations containing natural clayey materials, the situation with the colmated walls of the well is the most problematic. It has to do with the clayey materials penetrating the drilling fluid from the clayey collector which covers such permeable productive formation. Such clayey formations made up of the rocks which cover the productive formation can also be found in the colmated sphere on the wall of the well.

The method may be implemented only provided the structure of colmated formations is reliably estimated in the bottom hole area. The mineralogical composition of clayey formations is determined by the composition of used clays. Firstly, such clays are used to prepare the drilling fluid, and secondly, such clays bed in the roof of productive formation or form interlayers directly in the productive formation.

The information on the mineralogical composition of colmated rocks may quite reliably be obtained by analyzing the mineralogical composition of the rocks in the drilling fluid sampled at the end of drilling wells. Typically, clays are of mixed composition and contain mainly montmorillonite clays which are used to prepare the drilling fluid, and kaolinite clays which have fundamentally different properties if compared to montmorillonite ones.

The information on the composition of colmated deposits may reliably be obtained by analyzing oil. Normally, they are paraffin, asphalt and resin or asphalt and resin and paraffin deposits, and mineral salt deposits.

Given the information on the permeable productive formation which contain natural clayey materials, the information on the mineralogical composition of colmated rocks, the information on the composition of the deposits in the pores of the permeable formation and on the surface of the casing pipe, the operating atmosphere is determined to treat the bottom hole area of the well with high voltage pulse discharges. Therefore, the reagent solutions which interact with colmated formations of the organic and inorganic origin are used as the reagent solution injected to the formation treatment interval.

Such method is implemented with an electric discharge unit traveling from top to bottom of the hole. The number of pulses of such high voltage pulse discharges are set subject to the real porosity of the reservoir and the empirical dependence of the number of pulses of high voltage pulse discharges per meter of the reservoir and porosity of rocks pre-estimated with the core material, following the results the analysis conducted in the laboratory on the unit which simulates the conditions of the well, with the core material contaminated with deposits [see RU Patent No. 2,097,546, Sizonenko et al., "Method of Intensifying Oil Production"]. For example, if a formation with 2% porosity is treated, the number of pulses of high voltage pulse discharges equal 100.

Such treatment begins as the electric discharge device continuously moves from bottom to top.

As the bottom hole area is treated in the reagent atmosphere with high voltage pulse discharges, an electric burst takes place rapidly to release energy in the small channel of the discharge channel volume. The electrical discharge enables generation of dense plasma with the temperature reaching $10^4$ degrees K, i.e. 10,000° K, and the pressure of 250-280 MPa. The high concentration of energy, high pressure and temperature which develop in the discharge channel cause the channel rapidly to expand, and shock waves to generate. Such waves transform into acoustic waves with a wide range of frequencies, powerful hydro flows, pulsating steam and gas cavity, cavitation, electromagnetic and plasma thermal fields. Subject to such phenomena, the permeability of the bottom hole area of the formation increases as the number of cracks and channels grows, and as the reagent solution is injected into the perforating holes and pores of the formation.

After the electric discharge device stops traveling from top to the level of top perforation holes, the treatment with high voltage pulse discharges also stops, the well is pressurized until the pressure stabilizes in it. The pressure stabilizes usually after 8-12 hours.

At this stage, a complete chemical reaction between the reagent solution and colmated formations takes place.

Then, the bottom hole area of the well is further treated with high voltage discharges as the electric discharge device moves from bottom to top to remove the products of the chemical interaction between the reagent solution and colmated formations as the regularly reduced pressure is simultaneously generated and maintained in the well bore at the depth of the same interval as the steam and gas cavity collapses.

Example 1

If the composition of colmated formations includes montmorillonite clays, 10% aqueous solution of sodium bisulphate is prepared. To do it, a cementing unit is filled with 2 $m^3$ of water and 200 kg of powder-type reagent. The unit is operated in the circulating mode until the power-type reagent fully dissolves.

After the reagent fully dissolves, the pH value of the solution is 0.85. Then, the solution is injected into the oil well tubing, and the well is filled in the formation treatment interval in the wellbore area. The well tubing is lifted, and the electric discharge device is lowered with a logging cable to the bottom perforated holes. The well is treated as the electric discharge device continuously moves from bottom to top, and the reagent solution is squeezed into the formation treatment interval. The electric discharge unit enables the reagent solution effectively to penetrate in less permeable and less colmated natural interlayers in the formation treatment interval.

After the well is treated with high voltage pulse discharges, it is pressurized until the pressure stabilizes in it. The pressure stabilizes in 8-12 hours. The products of the chemical interaction of the reagent solution is removed from the formation treatment interval in the wellbore as the formation is treated as the electric discharge unit moves from bottom to top subject to regular pressure periodic pulsation as the steam and gas cavity collapses. As pressure pulsations are regularly excited, the pressure changes to reduce the pressure when the products of the chemical interaction of the reagent solution are removed with colmated formations. It all causes the bottom hole area of the formation to clean against colmated formations, and enables to increase the inflow of oil, gas, and gas condensate.

Example 2

The well is colmated with asphalt and resin deposits. 3% kerosene solution of sulphanol is used to remove colmated organic formations. The treatment is performed with the methods described in Example 1.

Thus, the oil production intensification method enables to ensure complete chemical interaction between the reagent solution and colmated formations and remove the products of the chemical interaction between the reagent solution and colmated formations, and thus increase the efficiency with which the bottom hole area colmated with various deposits is treated, and significantly increase the inflow of oil, gas, and gas condensate.

In summary, numerous benefits have been described which result from employing any or all of the concepts and the features of the various specific aspects of the present invention, or those that are within the scope of the invention.

The foregoing description of a preferred aspect of the invention has been presented for purposes of illustration and description. It is not intended to be exhaustive or to limit the invention to the precise form disclosed. Obvious modifications or variations are possible in light of the above teachings with regards to the specific aspects. The aspect was chosen and described in order to best illustrate the principles of the invention and its practical applications to thereby enable one of ordinary skill in the art to best utilize the invention in various aspects and with various modifications as are suited to the particular use contemplated. It is intended that the scope of the invention be defined by the claims which are appended hereto.

Although the invention will be described by way of examples hereinbelow for specific aspects having certain features, it must also be realized that minor modifications that do not require undo experimentation on the part of the practitioner are covered within the scope and breadth of this invention. Additional advantages and other novel features of the present invention will be set forth in the description that follows and in particular will be apparent to those skilled in the art upon examination or may be learned within the practice of the invention. Therefore, the invention is capable of many other different aspects and its details are capable of modifications of various aspects which will be obvious to those of ordinary skill in the art all without departing from the spirit of the present invention. Accordingly, the rest of the description will be regarded as illustrative rather than restrictive.

What is claimed is:

1. An oil production intensification method for drilling and pumping more oil from an oil reservoir in a well having a bottom zone with deposits of porous colmated rocks, comprising:

preliminarily determining the composition of the deposits of the oil reservoir by drilling and retrieving a core material;

analyzing the mineralogical composition of the retrieved core material;

injecting a reagent into the reservoir;

providing an electric discharge device and treating the bottom zone of the well with voltage pulse discharges continuously up and down in the reagent;

wherein the number of pulses of voltage pulse discharges is set subject to the real porosity of the reservoir and the empirical dependence of the number of pulses of voltage pulse discharges per meter of the reservoir and porosity of rocks pre-estimated from analysis of core material of the well;

travelling the electric discharge device up and down in the well; and completely chemically interacting the reagent with the colmated rock, which takes place after the electric discharge device stops travelling, and the treatment with voltage pulse discharges also stops;

capping the opening into the oil well allowing pressure to build-up while the pulse discharging is going on;

monitoring the pressures inside the capped well to determine whether or not the reaction is continuing or if it is stabilized, such that it can be determined that any chemical reaction between the reagents and materials inside the oil well have come to an equilibrium point, and will no longer be reacting; and extracting a much higher volume of oil than previously capable for a much longer term fix.

2. The method of claim 1, wherein the electrical discharge generates a plasma with the temperature reaching 10,000° K, and increasing the pressure to 250-280 MPa, such that a high concentration of energy, high pressure and temperature develops into a discharge channel, causing the oil well channel to expand, thereby generating shock waves.

* * * * *